US010151430B2

(12) United States Patent
Shi

(10) Patent No.: US 10,151,430 B2
(45) Date of Patent: Dec. 11, 2018

(54) LED LIGHT BULB

(71) Applicant: GARDENIA INDUSTRIAL LIMITED, Tortola (VG)

(72) Inventor: Zhu Shi, Zhong Shan (CN)

(73) Assignee: Gardenia Industrial Limited, Road Town, Tortola (VG)

( * ) Notice: Subject to any disclaimer, the term of this patent is extended or adjusted under 35 U.S.C. 154(b) by 0 days.

(21) Appl. No.: 15/669,501

(22) Filed: Aug. 4, 2017

(65) Prior Publication Data

US 2018/0031181 A1 Feb. 1, 2018

(30) Foreign Application Priority Data

Jul. 26, 2016 (CN) ..... 2016 2 0798037 U

(51) Int. Cl.

| | |
|---|---|
| ***F21K 9/232*** | (2016.01) |
| ***F21V 17/16*** | (2006.01) |
| ***F21K 9/238*** | (2016.01) |
| ***F21K 9/237*** | (2016.01) |
| ***F21V 3/02*** | (2006.01) |
| ***F21V 17/10*** | (2006.01) |
| ***F21V 23/00*** | (2015.01) |
| ***F21K 9/20*** | (2016.01) |
| *F21V 29/77* | (2015.01) |
| *F21Y 115/10* | (2016.01) |
| *F21V 17/12* | (2006.01) |
| *F21V 19/00* | (2006.01) |

(52) U.S. Cl.

CPC ..... *F21K 9/232* (2016.08); *F21K 9/20* (2016.08); *F21K 9/237* (2016.08); *F21K 9/238* (2016.08); *F21V 3/02* (2013.01); *F21V 17/101* (2013.01); *F21V 17/16* (2013.01); *F21V 23/001* (2013.01); *F21V 23/007* (2013.01); *F21V 17/12* (2013.01); *F21V 17/164* (2013.01); *F21V 19/0055* (2013.01); *F21V 29/77* (2015.01); *F21Y 2115/10* (2016.08)

(58) Field of Classification Search

CPC ..... F21V 3/02; F21V 17/164; F21V 17/16; F21K 9/232

USPC ..... 362/311.14

See application file for complete search history.

(56) References Cited

U.S. PATENT DOCUMENTS

| | | | | |
|---|---|---|---|---|
| 2011/0075412 | A1* | 3/2011 | Wu | F21K 9/00 362/235 |
| 2012/0051069 | A1* | 3/2012 | Lim | F21V 3/00 362/373 |
| 2014/0043816 | A1* | 2/2014 | Huang | F21V 17/10 362/249.02 |
| 2014/0126220 | A1* | 5/2014 | Chen | F21V 17/164 362/311.02 |

(Continued)

*Primary Examiner* — Laura Tso

(74) *Attorney, Agent, or Firm* — Lewis Roca Rothgerber Christie LLP

(57) ABSTRACT

An LED light bulb including a heat sink, an LED light board on a first end of the heat sink, a light-transmissive cover, and a power source drive module on a second end of the heat sink opposite to the first end. The LED light board includes a substrate and a plurality of LED lights on the substrate. The light-transmissive cover includes a cover body and a series of hooks on an edge of the cover body. The hooks are configured to detachably engage the LED light board or the heat sink to attach the light-transmissive cover.

9 Claims, 6 Drawing Sheets

(56) References Cited

U.S. PATENT DOCUMENTS

| | | | | |
|---|---|---|---|---|
| 2014/0369037 | A1* | 12/2014 | Hsu | F21V 29/74 362/235 |
| 2016/0186981 | A1* | 6/2016 | Chen | F21K 9/232 362/373 |
| 2016/0377234 | A1* | 12/2016 | Kwong | F21V 29/773 362/234 |

* cited by examiner

LED LIGHT BULB

CROSS-REFERENCE TO RELATED APPLICATION(S)

This application claims priority to and the benefit of Chinese Application No. 201620798037.8, filed Jul. 26, 2016 in the Chinese Patent and Trademark Office, the entire contents of which are incorporated herein by reference.

FIELD

The present disclosure relates generally to light emitting diode light bulbs.

BACKGROUND

There are various types of light bulbs, including light-emitting diode (LED) light bulbs. Related art LED bulbs typically include a translucent cover, a heat sink casing, an LED light board having at least one LED, a power driver module, and a pressure ring in between the LED light board and the first end of the heat sink casing. The translucent cover includes hooks to engage the pressure ring. The inclusion of the pressure ring in the related art can make the LED bulb have a complex structure that is cumbersome to assemble.

Further, the pressure ring is simultaneously connected with the LED light board and the heat sink, and since both the pressure ring and the radiator act as conductors, this structure leads to heat dissipation and inefficient energy use.

SUMMARY

The present disclosure is directed to various embodiments of a light-emitting diode (LED) light bulb. In one embodiment, the LED light bulb includes a heat sink, an LED light board on a first end of the heat sink, a light-transmissive cover, and a power source drive module on a second end of the heat sink opposite to the first end. The LED light board includes a substrate and a series of LED lights on the substrate. The light-transmission cover includes a cover body and a series of hooks on an edge of the cover body. The series of hooks are configured to detachably engage the LED light board or the heat sink to attach the light-transmissive cover.

The substrate may define a series of recesses corresponding to the series of hooks of the light-transmissive cover. Each hook of the series of hooks may include a resilient arm and a hook head extending inward from a free end of the resilient arm. When the light-transmissive cover is attached, the resilient arm of each of the series of hooks is received in a recess of the series of recesses and the hook head of each of the series of hooks engages a surface of the base plate facing the heat sink.

The first end of the heat sink may include a platform. The platform may define a series of fixing recesses corresponding to the series of hooks of the light-transmissive cover. Each hook of the series of hooks may include a resilient arm and a hook head extending inward from a free end of the resilient arm. When the light-transmissive cover is attached, the resilient arm of each of the series of hooks is received in a fixing recess of the series of fixing recesses, and the hook head of each of the series of hooks engages a lower surface of the platform.

The series of hooks may be arranged evenly around a center of the cover body.

The power source drive module may include a case defining a chamber and an LED drive circuit board in the chamber. An end of the case facing the heat sink may define two wire passages. Two internal wires may extend from the LED drive circuit board, out of the chamber through the two wire passages, and may be connected to the LED light board. A heat-conducting glue may be provided in the chamber connecting a periphery of the LED driving circuit board to the case.

The case may include a series of thermal vias filled with a heat-conducting glue.

At least one mounting through-hole may be defined in the case of the power source drive module. At least one screw extending through the at least one mounting through-hole and into the second end of the heat sink may couple the power source drive module to the heat sink.

The power source drive module may include a bracket for connecting the LED bulb to another component. The screw may pass through the bracket to connect the bracket to a lower end of the case.

The heat sink may include a base and a series of fins arranged evenly around a center of the base. The heat sink may include two passages aligned with the two wire passages in the case. Each passage of the two passages may extend from the first end of the heat sink to the second end of the heat sink. The two internal wires may extend through the two passages in the heat sink.

The series of fins of the heat sink may define external threads.

This summary is provided to introduce a selection of features and concepts of embodiments of the present disclosure that are further described below in the detailed description. This summary is not intended to identify key or essential features of the claimed subject matter, nor is it intended to be used in limiting the scope of the claimed subject matter. One or more of the described features may be combined with one or more other described features to provide a workable device.

BRIEF DESCRIPTION OF THE DRAWINGS

These and other features and advantages of embodiments of the present disclosure will become more apparent by reference to the following detailed description when considered in conjunction with the following drawings. In the drawings, like reference numerals are used throughout the figures to reference like features and components. The figures are not necessarily drawn to scale.

DETAILED DESCRIPTION

Figure 1:
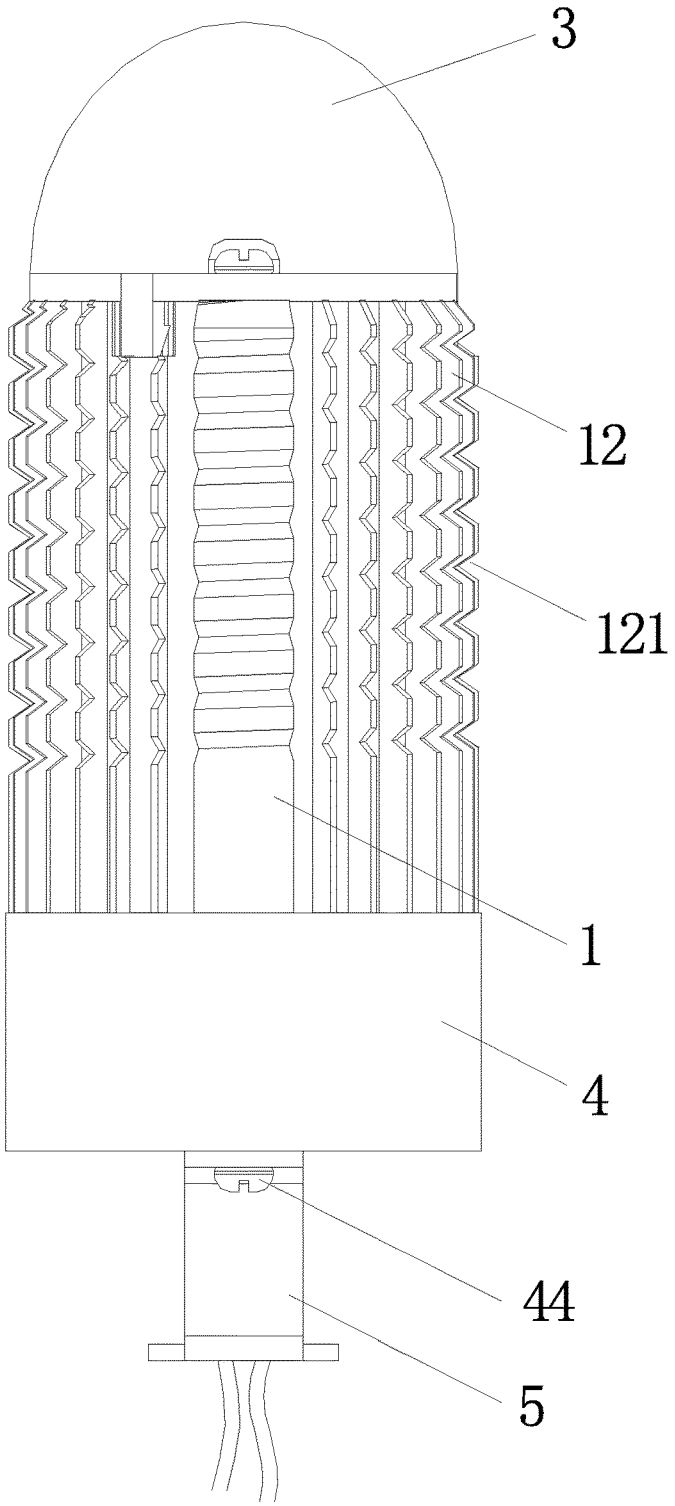
FIG. 1 is a side view of an LED light bulb according to one embodiment of the present disclosure.
Figure 2:
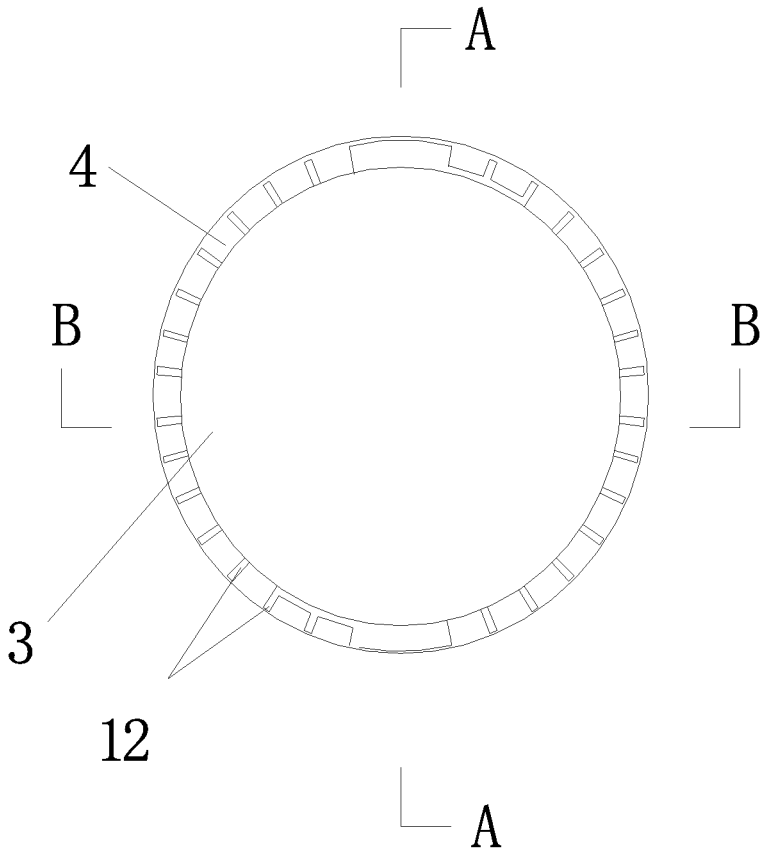
FIG. 2 is a top view of the embodiment of the LED light bulb illustrated in FIG. 1.

The present disclosure is directed to various embodiments of a light emitting diode (LED) light bulb. The LED light bulbs according to one or more embodiments of the present disclosure include a light-transmissive cover that connects directly to either a substrate of an LED light board or a heat sink, without the use of a pressure ring, which leads to a simpler structure, less complex assembly, and improved thermal efficiency compared to related art LED light bulbs including a pressure ring for connecting the light-transmissive cover.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof may not be repeated.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

With reference now to FIGS. 1-4, an LED bulb according to one or more embodiments of the present disclosure includes a heat sink 1 (e.g., a radiator), an LED light board 2 on a first end of the heat sink 1, a light-transmissive (e.g. translucent) cover 3, and a power source drive module 4 on a second end of the heat sink 1 opposite to the first end. The LED light board 2 includes a substrate (e.g., base plate) 22 and one or more LED lights 23 on the substrate 22. The LED lights 23 may be, for example, a single light emitting diode in a surface mount package or a plurality of light emitting diodes in separate surface mount packages. In the illustrated embodiment, the OD (outer diameter) of the substrate 22 is substantially equal to the OD of the light-transmissive cover 3. In the illustrated embodiment, the light-transmissive cover 3 includes a cover body 31 and a plurality of hooks 32 on an edge (e.g., a lower edge) of the cover body 31, where the plurality of hooks 32 are configured to detachably engage the LED light board 2 or the heat sink 1 to attach (e.g., directly attach) the light-transmissive cover 3.

The cover body 31 of the light-transmissive cover 3 may include any suitable translucent material. In one or more embodiments, the cover body 31 of the light-transmissive cover 3 may include one or more features configured to refract and/or reflect light passing through the cover body 31, such as, for instance, to increase the emission angle of the light emitted from the light-transmissive cover 3 and/or to reduce the presence of undesirable lighting effects (e.g., light and dark spots). Suitable features for refracting and/or reflecting light are described in U.S. patent application Ser. No. 14/997,175, filed Jan. 15, 2016 and entitled "LED Covers and LED Light Bulbs Incorporating the Same," the entire contents of which are incorporated herein by reference.

Figure 3:
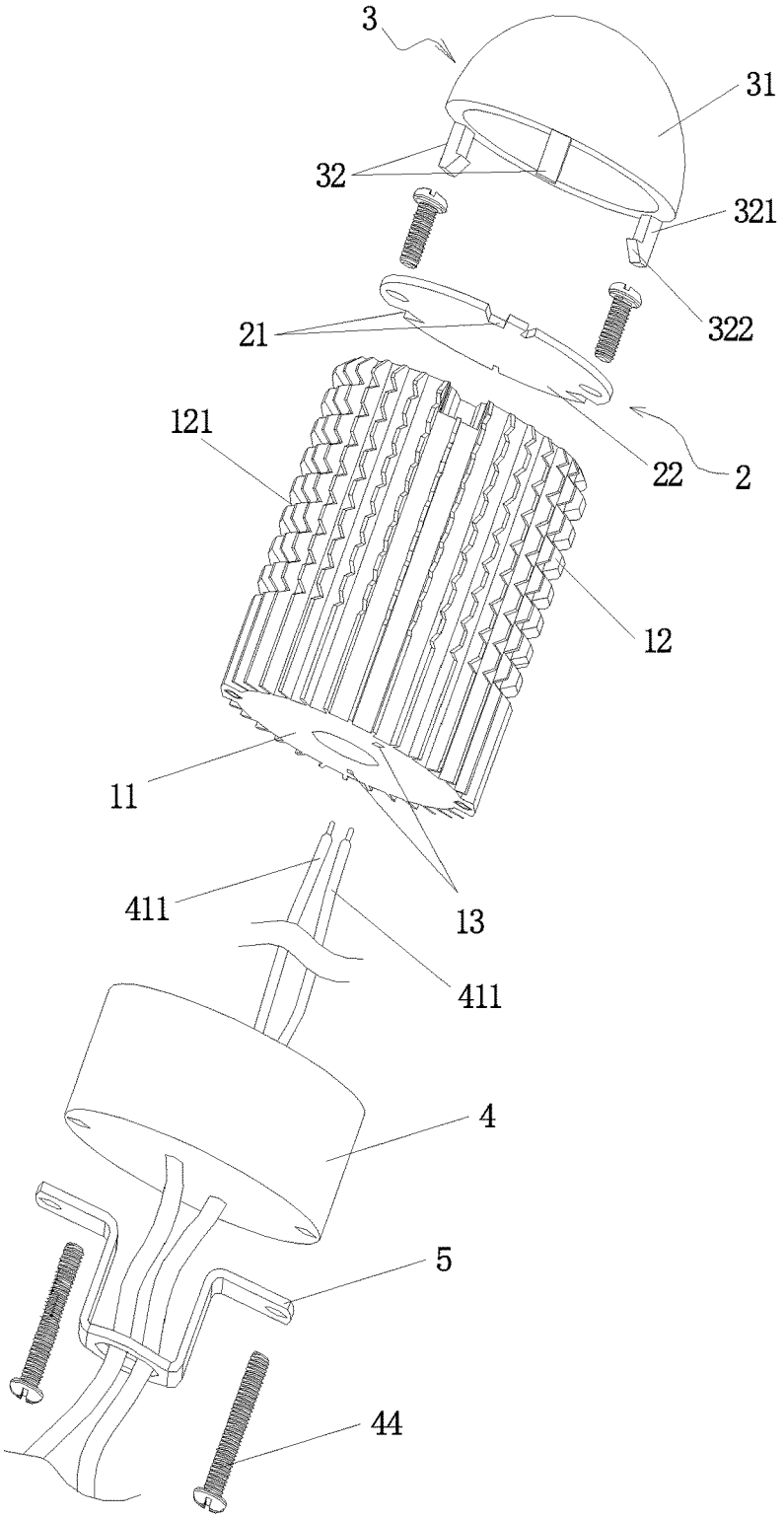
FIG. 3 is an exploded perspective view of the embodiment of the LED light bulb illustrated in FIG. 1.
Figure 4:
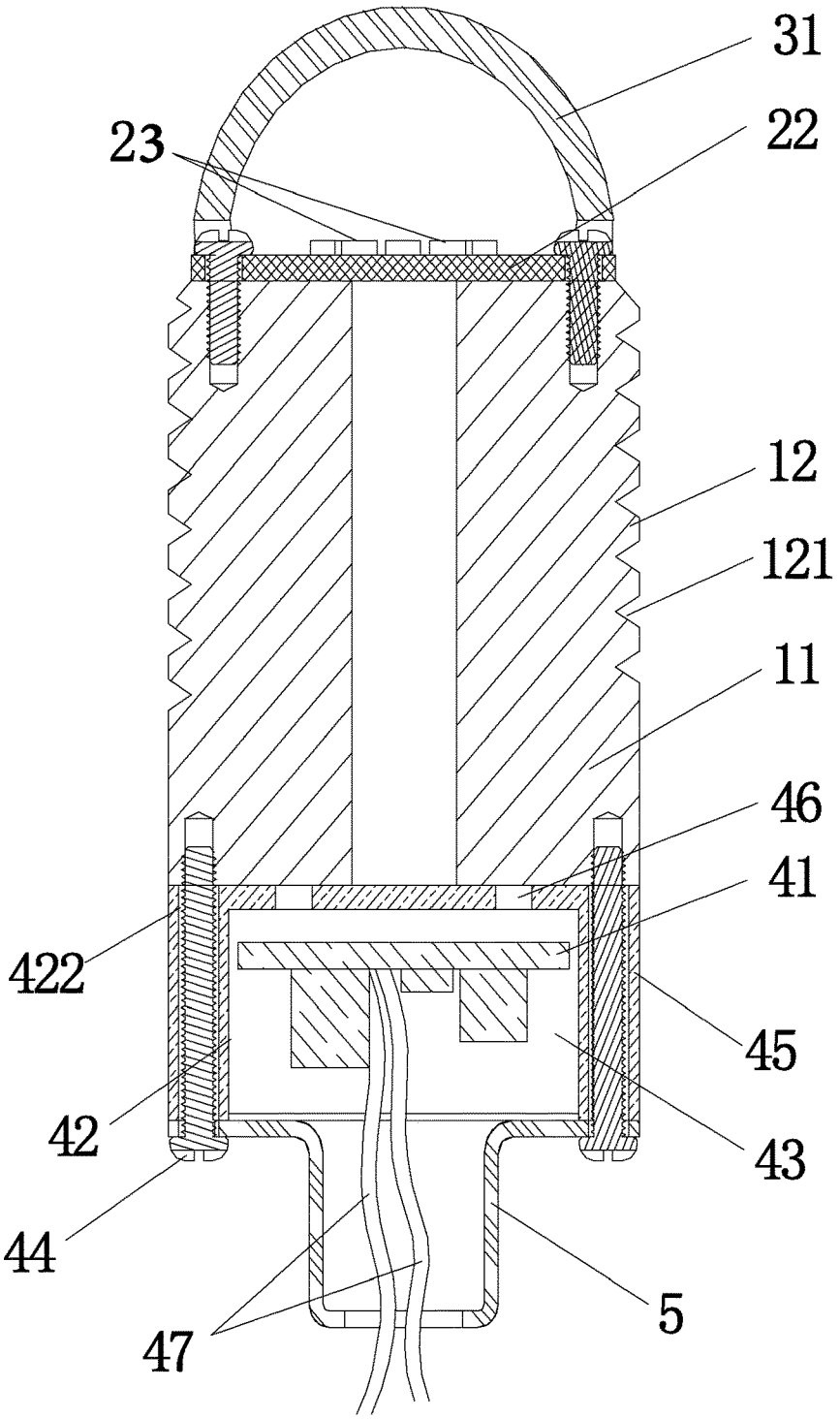
FIG. 4 is a cross-sectional view of the embodiment of the LED light bulb illustrated in FIG. 1 taken along line A-A in FIG. 2.
Figure 5:
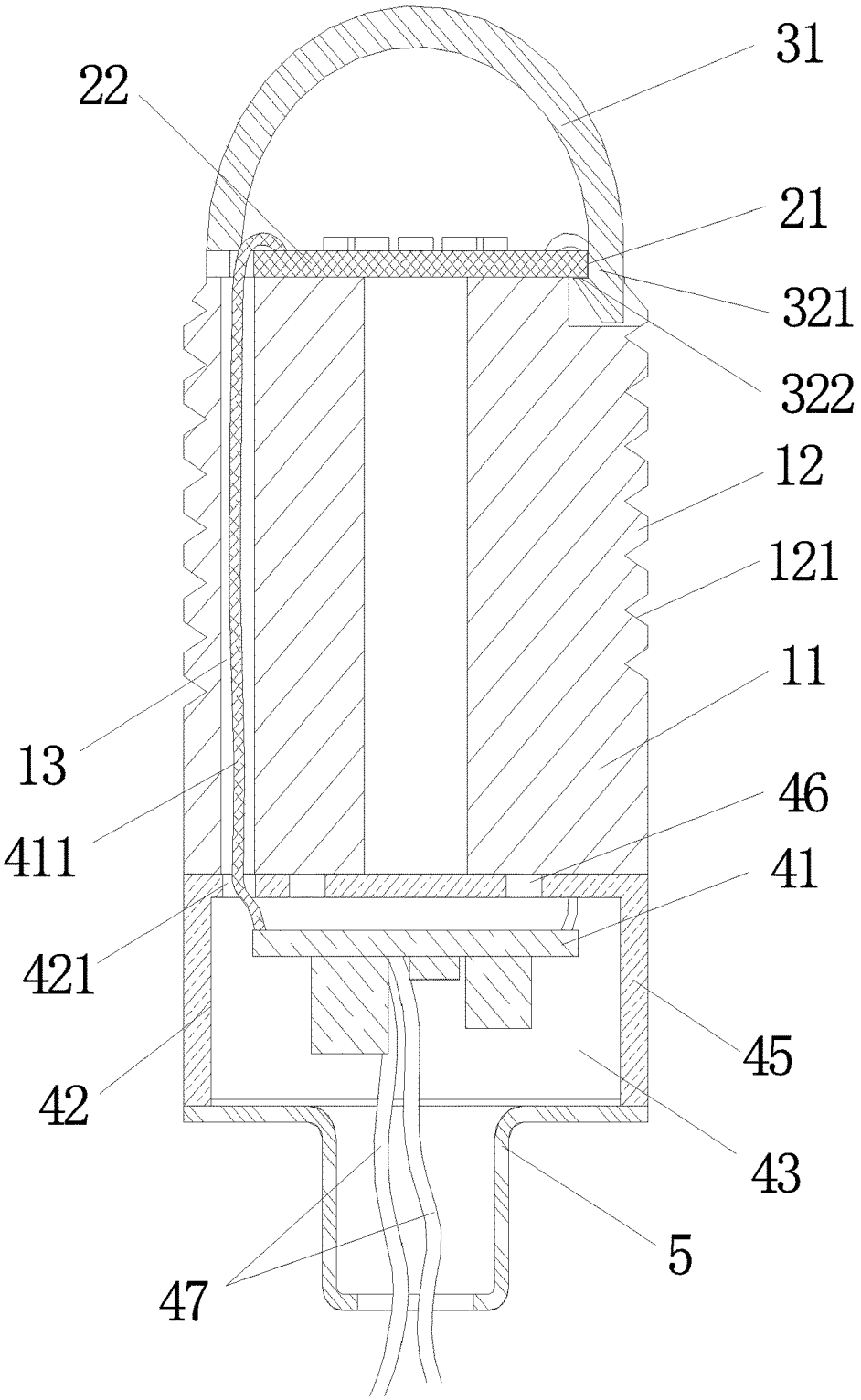
FIG. 5 is a cross-sectional view of the embodiment of the LED light bulb illustrated in FIG. 1 taken along line B-B in FIG. 2.

With reference now to the embodiment illustrated in FIGS. 3 and 5, the substrate 22 defines a plurality of recesses 21 corresponding to the plurality of hooks 32 of the light-transmissive cover 3. In the illustrated embodiment, each of the plurality of hooks 32 includes a resilient arm 321 and a hook head 322 extending inward from a free end of the resilient arm 321. Although in the illustrated embodiment each of the hooks 32 has the same configuration, in one or more embodiments, the hooks 32 may have different configurations. In the illustrated embodiment, when the light-transmissive cover 3 is attached, the resilient arms 321 of the hooks 32 are received in corresponding recesses 21 and the hook heads 322 of the hooks 32 engage (e.g., directly engage) a surface (e.g., a lower surface) of the base plate 22 facing the heat sink 1.

Figure 6:
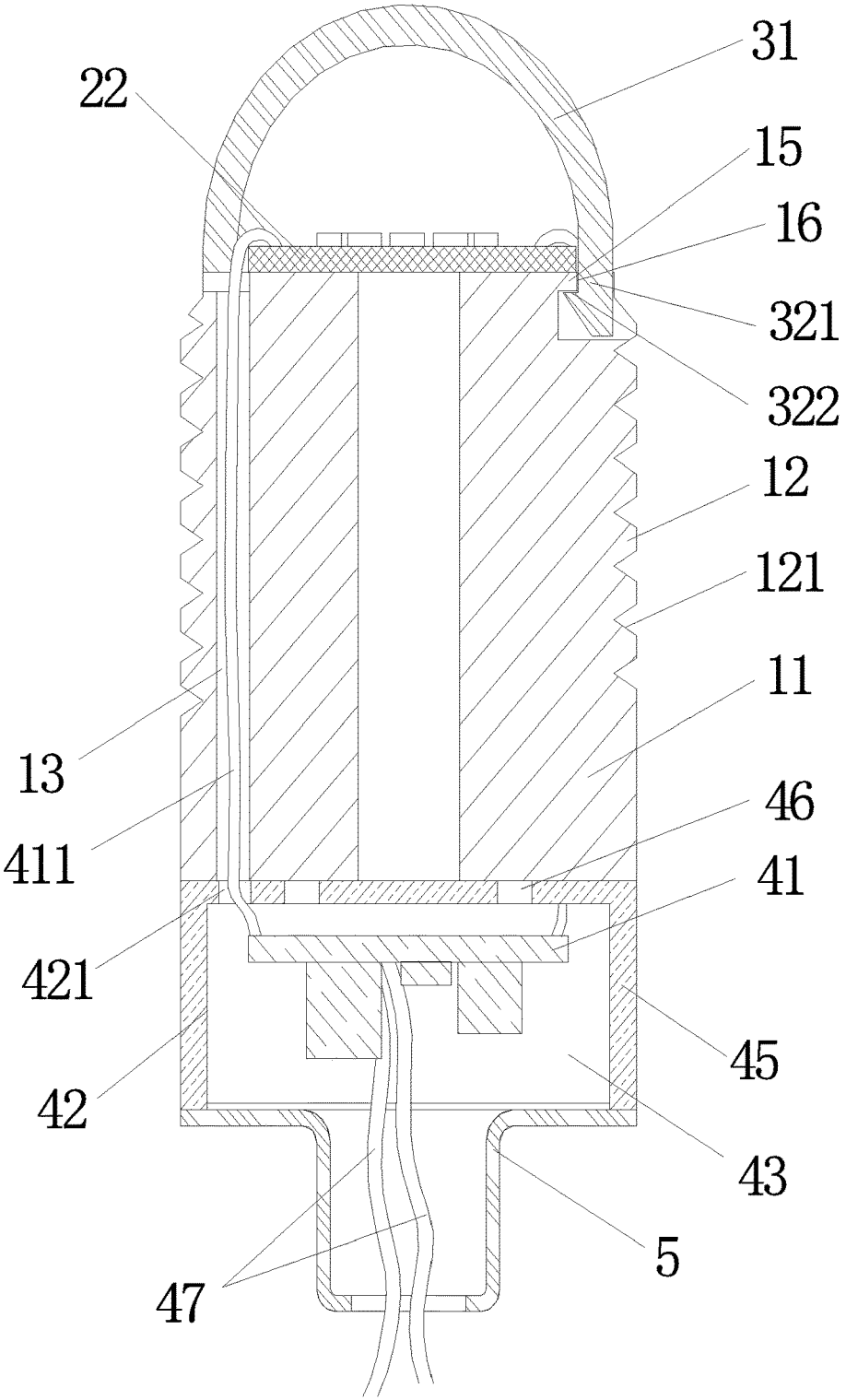
FIG. 6 is a cross-sectional view of an LED light bulb according to another embodiment of the present disclosure.

FIG. 6 depicts an LED light bulb according to another embodiment of the present disclosure. In FIG. 6, some of the same reference numbers used in the embodiment of the lighting fixture depicted in FIGS. 1-5 are used to refer to the same or similar components. However, components having the same reference numbers in the embodiment depicted in FIGS. 1-5 and the embodiment depicted in FIG. 6 may not be identical and, instead, may include differences as described below. In the embodiment of the LED bulb illustrated in FIG. 6, the first end of the heat sink 1 includes a platform 15, with the platform 15 defining a plurality of fixing recesses 16 corresponding to the plurality of hooks 32 of the light-transmissive cover 3. Each hook of the plurality of hooks 32 includes a resilient arm 321 and a hook head 322 extending inward from a free end of the resilient arm 321. When the light-transmissive cover 3 is attached, the resilient arms 321 of the hooks 32 are received in corresponding fixing recesses 16 and the hook heads 322 of the hooks 32 engage (e.g., directly engage) a surface (e.g., a lower surface) of the platform 15 facing away from the substrate 22. In one or more embodiments, the plurality of hooks 32 are arranged evenly around a center of the cover body 31.

In the illustrated embodiment, the power source drive module 4 includes a case 45 defining a chamber 42 and an LED drive circuit board 41 in the chamber 42. An end of the case 45 facing the heat sink 1 defines at least one wire passage 421. At least one internal wire 411 extends from the LED drive circuit board 41, out of the chamber 42 through at least one of the wire passages 421, and is connected to the LED light board 2. A heat-conducting glue 43 is provided in the chamber 42 connecting a periphery of the LED drive circuit board 41 to the case 45.

In one or more embodiments, the case 45 also includes a plurality of thermal vias 46 filled with heat-conducting glue 43. At least one mounting through-hole 422 is defined in the case 45 of the power source drive module 4. At least one screw 44 extends through the at least one mounting through-hole 422 and into the second end of the heat sink 1 to couple the power source drive module 4 to the heat sink 1. A wire 47 connected to an external power source (e.g., mains) is connected to the LED drive circuit board 41 to provide power to the LED bulb.

In one or more embodiments, the power source drive module 4 also includes a bracket 5 for connecting the LED bulb to another component. The screw 44 passes through the bracket 5 to connect the bracket 5 to a lower end of the case 45.

In one or more embodiments, the heat sink 1 includes a base 11 and a plurality of fins 12 arranged evenly around a center of the base 11. In the illustrated embodiment, the heat sink 1 also includes at least one passage 13 aligned with at least one wire passage 421 in the case 45. The at least one passage 13 extends from the first end of the heat sink 1 to the second end of the heat sink 1. At least one internal wire 411 extends through at least one passage 13 in the heat sink 1. Additionally, in the illustrated embodiment, the plurality of fins 12 of the heat sink 1 define external threads 121.

While this invention has been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims.

What is claimed is:

1. An LED bulb comprising:

a heat sink, an LED light board on a first end of the heat sink, the LED light board comprising a substrate and a plurality of LED lights on the substrate;

a light-transmissive cover comprising a cover body and a plurality of hooks on an edge of the cover body, the plurality of hooks configured to detachably engage the LED light board to attach the light-transmissive cover; and a power source drive module on a second end of the heat sink opposite to the first end, wherein:

the substrate defines a plurality of recesses corresponding to the plurality of hooks of the light-transmissive cover, each hook of the plurality of hooks comprises a resilient arm and a hook head extending inward from a free end of the resilient arm, and when the light-transmissive cover is attached, the resilient arm of each of the plurality of hooks is received in a recess of the plurality of recesses and the hook head of each of the plurality of hooks engages a surface of the substrate facing the heat sink.

2. An LED bulb comprising:

a heat sink, an LED light board on a first end of the heat sink, the LED light board comprising a substrate and a plurality of LED lights on the substrate;

a light-transmissive cover comprising a cover body and a plurality of hooks on an edge of the cover body, the plurality of hooks configured to detachably engage the heat sink to attach the light-transmissive cover; and a power source drive module on a second end of the heat sink opposite to the first end, wherein:

the first end of the heat sink comprises a platform, the platform defining a plurality of fixing recesses corresponding to the plurality of hooks of the light-transmissive cover, each hook of the plurality of hooks comprises a resilient arm and a hook head extending inward from a free end of the resilient arm, and when the light-transmissive cover is attached, the resilient arm of each of the plurality of hooks is received in a fixing recess of the plurality of fixing recesses and the hook head of each of the plurality of hooks engages a lower surface of the platform.

3. The LED bulb of claim 1, wherein the plurality of hooks are arranged evenly around a center of the cover body.

4. The LED bulb of claim 1, wherein:

the power source drive module comprises a case defining a chamber and an LED drive circuit board in the chamber, an end of the case facing the heat sink defines two wire passages, two internal wires extend from the LED drive circuit board, out of the chamber through the two wire passages, and are connected to the LED light board, and a heat-conducting glue is provided in the chamber connecting a periphery of the LED drive circuit board to the case.

5. The LED bulb of claim 4, wherein the case further comprises a plurality of thermal vias filled with a heat-conducting glue.

6. The LED bulb of claim 5, further comprising:

at least one mounting through-hole defined in the case of the power source drive module; and at least one screw extending through the at least one mounting through-hole and into the second end of the heat sink to couple the power source drive module to the heat sink.

7. The LED bulb of claim 6, wherein the power source drive module further comprises a bracket for connecting the LED bulb to another component, and wherein the screw passes through the bracket to connect the bracket to a lower end of the case.

8. The LED bulb of claim 7, wherein:

the heat sink comprises a base and a plurality of fins arranged evenly around a center of the base, the heat sink comprises two passages aligned with the two wire passages in the case, each passage of the two passages extending from the first end of the heat sink to the second end of the heat sink, and the two internal wires extend through the two passages in the heat sink.

9. The LED bulb of claim 8, wherein the plurality of fins of the heat sink define external threads.

* * * * *